US009208915B2

(12) United States Patent
Hussey et al.

(10) Patent No.: US 9,208,915 B2
(45) Date of Patent: Dec. 8, 2015

(54) ION EXCHANGE REGENERATION AND NUCLIDE SPECIFIC SELECTIVE PROCESSES

(75) Inventors: Dennis Frank Hussey, Emerald Hills, CA (US); David Bradbury, Tresham (GB); George Richard Elder, Westbury-on-Severn (GB); Lisa Maxine Edwards, Granbury, TX (US)

(73) Assignee: Electric Power Research Institute, Inc., Palo Alto, CA (US)

( * ) Notice: Subject to any disclaimer, the term of this patent is extended or adjusted under 35 U.S.C. 154(b) by 621 days.

(21) Appl. No.: 13/267,603

(22) Filed: Oct. 6, 2011

(65) Prior Publication Data

US 2012/0088949 A1 Apr. 12, 2012

Related U.S. Application Data

(60) Provisional application No. 61/390,272, filed on Oct. 6, 2010.

(51) Int. Cl.
*G21F 9/00* (2006.01)
*G21F 9/14* (2006.01)
(Continued)

(52) U.S. Cl.
CPC .. *G21F 9/12* (2013.01); *G21F 9/28* (2013.01); *G21F 9/30* (2013.01)

(58) Field of Classification Search
CPC ..... C02F 1/42; C02F 1/46; C02F 1/463; C02F 2101/006; C02F 2303/16; C02F 2001/422; C02F 2001/425; C02F 2001/427; C02F 2001/46
See application file for complete search history.

(56) References Cited

U.S. PATENT DOCUMENTS 3,340,200 A * 9/1967 Noble ..... 521/26
3,940,628 A * 2/1976 Stock et al. ..... 250/435
(Continued)

FOREIGN PATENT DOCUMENTS

EP 0 111 839 A1 6/1984
JP 2006-159013 A 6/2006
JP 2006159013 A * 6/2006

OTHER PUBLICATIONS

Machine translation of JP2006159013A obtained from Espacenet, pp. 1-8.*

(Continued)

*Primary Examiner* — Allison Fitzsimmons
*Assistant Examiner* — Clare Perrin
(74) *Attorney, Agent, or Firm* — Curatolo Sidoti Co., LPA; Joseph G. Curatolo; Salvatore A. Sidoti

(57) ABSTRACT

A method of processing ion exchange resin radioactive waste, wherein the radioactive waste contains a plurality of fractions of radioactive waste based on density, which may include cation resin waste and anion resin waste, wherein at least one of the plurality of fractions comprises a total concentration of at least one radionuclide, including performing at least one of the following operations (i), (ii) or (iii): (i) separating the at least one of the plurality of fractions from the radioactive waste utilizing a moving freeboard; (ii) separating the radioactive waste into cation resin waste and anion resin waste; or (iii) removing at least a portion of the total concentration of the at least one radionuclide from: the radioactive waste; the at least one of the plurality of fractions separated by the moving freeboard; or at least one of the radioactive waste, the cation resin waste or the anion resin waste.

15 Claims, 4 Drawing Sheets

(51) Int. Cl.

| | |
|---|---|
| ***G21F 9/16*** | (2006.01) |
| ***G21F 9/20*** | (2006.01) |
| ***B01J 49/00*** | (2006.01) |
| ***C02F 1/42*** | (2006.01) |
| ***G21F 9/12*** | (2006.01) |
| ***G21F 9/28*** | (2006.01) |
| ***G21F 9/30*** | (2006.01) |
| *B09B 1/00* | (2006.01) |
| *B09B 3/00* | (2006.01) |
| *B09B 5/00* | (2006.01) |
| *C02F 11/00* | (2006.01) |
| *A62D 3/00* | (2007.01) |
| *C04B 18/04* | (2006.01) |
| *B01D 11/00* | (2006.01) |

(56) References Cited

U.S. PATENT DOCUMENTS

| | | | | |
|---|---|---|---|---|
| 4,389,253 | A * | 6/1983 | Nishimura et al. | 134/1 |
| 4,636,335 | A | 1/1987 | Kawamura et al. | |
| 4,687,581 | A * | 8/1987 | Macedo et al. | 210/670 |
| 4,764,338 | A * | 8/1988 | Uchida et al. | 376/313 |
| 4,891,138 | A * | 1/1990 | Chonan et al. | 210/675 |
| 5,207,897 | A * | 5/1993 | Baird et al. | 210/109 |
| 6,682,646 | B2 | 1/2004 | Wood et al. | |
| 6,972,095 | B1 * | 12/2005 | Bushart et al. | 210/670 |
| 2003/0178308 | A1 * | 9/2003 | Wood et al. | 204/533 |

OTHER PUBLICATIONS

PCT/US2011/055115—International Preliminary Report on Patentability, Apr. 9, 2013.

Conesep ® Brochure; http://www.kennicott.co.uk/NR/rdonlyres/E3B79B72-4538-4CD3-9B5F-84232E5F5EDB/0/CKWTCONESEPbrochure.pdf; last retrieved Oct. 4, 2010.

Gunn, James; "Disposal of Bulk Alkali Metal Alloy from a Fast Breeder Reactor"; Presented to EPRI conferences, Dounreay; Sep. 2002; Scotland.

Garn, T.G., et al; "Demonstration of Various Ion Exchange Sorbents for the Removal of Cesium and Strontium from TAN Groundwater"; IMEEL/EXT-97-00825; Aug. 1997; pp. i-24; Idaho National Engineering and Environmental Laboratory, Idaho, USA.

"Pilot Demontration of the EPRI DFDX Chemical Decontamination Technology"; EPRI Technical Report; Nov. 2004; Bradtec DeconTechnologies Ltd., UK.

Flow—A publication about cost effective demineralization with the DOWEX®UPCORE® packed bed system from Dow Water Solutions; Dec. 2007; The Dow Chemical Company.

Pickett, J.B., et al.; "Highly Selective Nuclide Removal from the R-Reactor Diassembly Basin at the SRS"; WM'02 conference,Feb. 24-28, 2002; Tucson, AZ, USA.

"New Developments and Improvements in Processing 'Problematic' Radioactive Waste"; results of a coordinated research project 2003-2007; IAEA-TECDOC-1579; Dec. 2007; International Atomic Energy Agency.

"Waste Stream 5B325 DFR Ion Exchange Columns"; United Kingdom Atomic Energy Authority; Nuclear Decommisioning Authority; Dounreay; 2007.

Web information regarding the DOWEX®UPCORE® system; http://www.downwaterandprocess.com/support_training/literature_manuals/ix_techinfo/upcore_app.htm; first accessed; Sep. 9, 2010; last accessed; Dec. 15, 2011.

Web information: "How to Design an Ion Exchange System"; http://www.downwaterandprocess.com/support_training/literature_manuals/ix_techinfo/designstps.htm; first accessed; Sep. 9, 2010; last accessed; Dec. 15, 2011.

International Search Report, Form PCT/ISA/210, mailed Feb. 27, 2012, for corresponding PCT International Patent Application No. PCT/US2011/055115.

Written Opinion, Form PCT/ISA/237, mailed Feb. 27, 2012, for corresponding PCT International Patent Application No. PCT/US2011/055115.

EP 11831600.9 European Extended Search Report, mailed Mar. 25, 2014.

* cited by examiner

ION EXCHANGE REGENERATION AND NUCLIDE SPECIFIC SELECTIVE PROCESSES

This application claims the benefit of the filing date, under 35 U.S.C. §119(e), of U.S. Provisional Application for Patent Ser. No. 61/390,272, filed on Oct. 6, 2010.

A method of processing solid radioactive ion exchange resin waste is provided, comprising separating the radioactive ion exchange resin waste into fractions based on density, and/or removing at least a portion of the concentration of at least one radionuclide from the radioactive ion exchange resin waste. The concentration of the at least one radionuclide separated and/or removed from the radioactive ion exchange resin waste may be converted into a reduced-volume waste form, referred to herein as "regenerant waste". The radioactive ion exchange resin waste may contain sludge. The terms "radioactive ion exchange resin waste" and "radioactive waste" are used interchangeably herein, and both refer to radioactive ion exchange resin waste material(s), unless otherwise noted.

The radioactive wastes which result from the separation and/or removal of the radioactive ion exchange resin waste may be in solid or liquid form. However, in certain jurisdictions, liquid radioactive wastes may be regulated. In such jurisdictions, production of liquid radioactive wastes may be undesirable. In circumstances where production of liquid radioactive wastes is undesirable, the liquids used in the processing of the radioactive wastes may be removed prior to final disposition of the radioactive wastes, in order to produce solid radioactive wastes for disposal and/or storage. The removed liquids may then be purified and/or recycled. Without limitation, the present methods may remove radionuclides from radioactive wastes in order to convert the radioactive wastes into forms which are more easily disposed of and/or more easily stored, at lower costs of disposal and/or storage.

Radioactive wastes which may be processed according to the present method may arise from various sources, many of which are associated with the operation of nuclear power plants. For example, reactor water purification circuits utilize mixed ion exchangers (anionic and cationic) to purify reactor water and remove radioactive materials during operation of the reactor. Another source is chemical decontamination, which has become an established method of reducing the radiation exposure of workers at nuclear power plants. Certain chemical decontamination processes include adding chemicals to a part of the cooling water circuit of a nuclear power plant, where the chemicals dissolve radioactive deposits from the surfaces of the cooling water circuit. In certain processes, the chemicals and the radioactive components are removed from the solution circulating through the cooling water circuit by ion exchange.

A similar process can be used to decontaminate decommissioned nuclear power plant components. When certain components of a nuclear power plant are replaced, the components that are removed are processed in order to remove some or all of the radioactive deposits which may be present on the decommissioned components. The decontamination of these components not only reduces worker exposure to radiation, but also reduces the radioactive level of the components so that the components may be categorized in a lower category of radioactivity. If the components are processed to below a certain level of radioactivity, they may be categorized as non-radioactive, which would allow for reuse or recycling.

Processes such as those discussed above may result in creation of radioactive waste material, including ion exchange resins. All the radioactive materials which have been removed via the processes discussed above are collected in the radioactive waste material. Radioactive ion exchange resin waste materials are not a convenient waste form, because only a small fraction of their weight and/or volume represents the radioactive material.

What is needed is a method of processing resin radioactive waste which optimizes the concentration of radioactive material such that the weight and/or volume of the radioactive waste may be minimized, but that it may still be handled and stored efficiently, or allow the option to dispose of the resin waste at a licensed facility.

Figure 1:
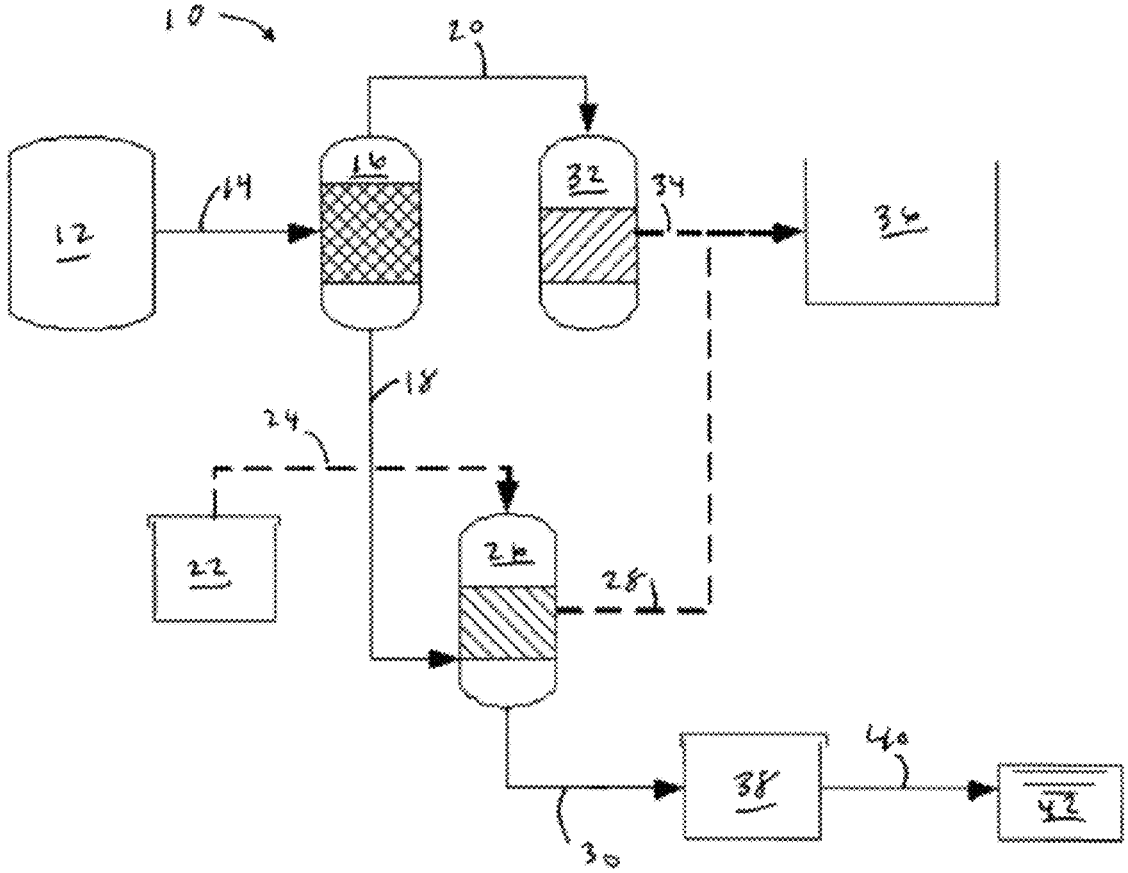
FIG. 1 is a flow diagram showing one embodiment of the present method(s).

Provided is a method of processing ion exchange resin radioactive waste, wherein the radioactive waste contains a plurality of fractions of radioactive waste based on density, which may include cation resin waste and anion resin waste, wherein at least one of the plurality of fractions comprises a total concentration of at least one radionuclide, comprising performing at least one of the following operations (i), ii or (iii): (i) separating the at least one of the plurality of fractions from the radioactive waste utilizing a moving freeboard; (ii) separating the radioactive waste into cation resin waste and anion resin waste; or (iii) removing at least a portion of the total concentration of the at least one radionuclide from: (a) the radioactive waste; (b) the at least one of the plurality of fractions separated from by the moving freeboard; or (c) at least one of the cation resin waste or the anion resin waste. In certain embodiments, any liquids used in the processes are either recycled, or if extremely low in radioactivity, may be disposed of as liquids.

Cation resin wastes are cation exchange resins which are used in ion exchange processes in order to remove cations from a target material. Cation exchange resins are resins which exchange their cations for other cations in the target material. Similarly, anion resin wastes are anion exchange resins which are used in ion exchange processes in order to remove anions from a target material. Anion exchange resins are resins which exchange their anions for other anions in the target material. Both the cation and anion exchange resins used in the methods described herein remove the target radionuclides from radioactive wastes by exchanging the harmless ions which are present in the cation and anion resins prior to processing for the radionuclides.

In the United States, land disposal of radioactive waste is governed, at least in part, by 10 C.F.R. Part 61. Radioactive waste (resin waste or other types of waste) may be classified as Class A, Class B, or Class C waste under 10 C.F.R. §61.55 (a)(4) and (7), utilizing Table 2 of 10 C.F.R. §61.55, which is reproduced below. Generally, if a radioactive waste complies with the maximum concentrations listed in Col. 1, it is Class A waste. Generally, if a radioactive waste complies with the maximum concentrations listed in Col. 2, but exceeds any of the concentration limits in Col. 1, it is Class B waste. Generally, if a radioactive waste complies with the maximum concentrations listed in Col. 3, but exceeds any of the concentration limits in Col. 2, it is Class C waste. It is noted that the sum of fractions rule found in 10 C.F.R. §61.55(a)(7) may effect whether a radioactive waste is classified as Class A, Class B, or Class C. As used herein, the term "greater than Class C"

("GTCC") waste means radioactive waste that exceeds the definition of Class C waste as described herein.

TABLE 2

10 C.F.R. § 61.55

| Radionuclide | Concentration, curies per cubic meter | | |
|---|---|---|---|
| | Col. 1 | Col. 2 | Col. 3 |
| Total of all nuclides with less than 5 year half-life | 700 | ([1]) | ([1]) |
| H-3 | 40 | ([1]) | ([1]) |
| Co-60 | 700 | ([1]) | ([1]) |
| Ni-63 | 3.5 | 70 | 700 |
| Ni-63 in activated metal | 35 | 700 | 7000 |
| Sr-90 | 0.04 | 150 | 7000 |
| Cs-137 | 1 | 44 | 4600 |

[1]There are no limits established for these radionuclides in Class B or C wastes. Practical considerations such as the effects of external radiation and internal heat generation on transportation, handling, and disposal will limit the concentrations for these wastes. These wastes shall be Class B unless the concentrations of other nuclides in Table 2 determine the waste to the Class C independent of these nuclides.

It is noted that Table 2 of 10 C.F.R. §61.55 provides definitions based on short-lived radionuclides. Table 1 of 10 C.F.R. §61.55 provides guidance as to whether radioactive waste will be Class A or Class C based on long-lived radionuclides. Because short-lived radionuclides may typically determine the category of radioactive waste, for the purposes of the present methods, only Table 2 of 10 C.F.R. §61.55, in addition to the provisions of 10 C.F.R. §61.55(a)(7), will provide definitions of Class A, Class B and Class C wastes.

As is apparent from Table 2 above, there is a considerable margin between Class A wastes and Class B and C wastes. At present, there is often no disposal path for Class B and C wastes, which means that they will commonly be stored on-site at the waste-generating nuclear power plant. However, there is, in many instances, an established disposal path for Class A wastes, and therefore they need not be stored on-site. For these reasons, it is desirable to reduce the volume of Class B and C wastes as much as possible, so that on-site storage costs may be minimized. Thus, the present methods may create two streams of waste: a Class A waste stream which may be disposed of according to disposal paths which are currently in place; and Class B and/or Class C waste streams which have a minimum volume and may therefore be cost-effectively stored on-site at the waste-generating nuclear power plant.

In certain embodiments, the methods discussed above may further include that, after performing at least one of operations (i)-(iii), at least one of: (a) the radioactive waste; (b) the at least one of the plurality of fractions; or (c) at least one of the cation resin waste or the anion resin waste; has a residual concentration of the at least one radionuclide, and is capable of being classified as Class A waste based on said residual concentration; and wherein a regenerant waste, which comprises: (1) the radioactive waste remaining after separating the at least one of the plurality of fractions in operation (i); and/or (2) the at least a portion of the total concentration of the at least one radionuclide which has been removed via operation (iii); has a regenerant concentration of the at least one radionuclide, and is capable of being classified as Class A waste, Class B waste, Class C waste or GTCC waste, based on the regenerant concentration.

The above description classifies radioactive wastes in reference to regulations which are applicable in the United States. The International Atomic Energy Agency ("IAEA") also provides guidance for classifying radioactive wastes in order to process and dispose of radioactive wastes safely. Further, laws and regulations in many countries differ as to classifying radioactive wastes for the purposes of disposal and/or storage. Therefore, the present methods provide means by which radioactive waste may be processed in order to minimize the volume of radioactive wastes which are difficult to dispose of, expensive to dispose of, and/or are not capable of disposal in established disposal pathways, irrespective of the particular local laws or regulations.

As used herein, the term "disposable waste" means radioactive waste which, based at least upon the concentration(s) of radionuclides found therein, is easily and/or inexpensively disposable via established disposal pathways according to local laws and/or regulations. As used herein, the term "storable waste" means radioactive waste which, based at least upon the concentration(s) of radionuclides found therein, is highly regulated according to local laws and/or regulations, and therefore it is desirable to minimize the volume of such radioactive wastes. For example, it may be desirable to minimize the volume of radioactive wastes for which no disposal pathways exist according to local laws and/or regulations, or it may be desirable to minimize the volume of such wastes when disposal pathways exist, but are not cost-effective. As used herein, the term "local laws and/or regulations" means the laws and/or regulations of a governing entity which regulates nuclear energy production.

Without limitation, Class A wastes (as described above) may typically include disposable waste, while Class B waste, Class C waste, and GTCC waste may typically include storable waste. While these terms may be used interchangeably herein, it should not be assumed that the definitions of these terms are the same. On the contrary, "Class A waste", "Class B waste" and "Class C waste" are defined in reference to U.S. regulations, while "GTCC waste" is defined in reference to the definition of Class C waste. "Disposable waste" and "storable waste" are defined herein generically in order to encompass the various laws and/or regulations found in countries which regulate production of nuclear energy.

In certain embodiments, the methods discussed above may further include that, after performing at least one of operations (i)-(iii), at least one of: (a) the radioactive waste; (b) the at least one of the plurality of fractions; or (c) at least one of the cation resin waste or the anion resin waste; has a residual concentration of the at least one radionuclide, and is capable of being classified as disposable waste; and wherein a regenerant waste, which comprises: (1) the radioactive waste remaining after separating the at least one of the plurality of fractions in operation (i); and/or (2) the at least a portion of the total concentration of the at least one radionuclide which has been removed via operation (iii); has a regenerant concentration of the at least one radionuclide, and is capable of being classified as storable waste.

The IAEA provides four classifications of radioactive waste which are pertinent to the present methods: very low level waste ("VLLW"), low level waste ("LLW"), intermediate level waste ("ILW"), and high level waste ("HLW"). Quantitative values of allowable activity content for each significant radionuclide are not specified by the IAEA, and are to be specified by local regulatory bodies on the basis of safety assessments for individual disposal sites.

VLLW is defined as waste which is suitable for disposal in near surface landfill type facilities with limited regulatory control. Typical waste in this class includes soil and rubble with low levels of activity concentration. Concentrations of longer lived radionuclides in VLLW are generally very limited. VLLW may typically be disposable waste.

LLW is defined as waste which requires robust isolation and containment for periods of up to a few hundred years and is suitable for disposal in engineered near surface facilities. LLW may include short lived radionuclides at higher levels of activity concentration, and also long lived radionuclides, but only at relatively low levels of activity concentration. In terms of radioactive waste safety, a radionuclide with a half-life of less than about 30 years is considered to be short lived. Depending on concentration and local regulations, LLW may be disposable waste, or may be storable waste.

ILW is defined as waste which, because of its content, particularly of long lived radionuclides, requires a greater degree of containment and isolation than that provided by near surface disposal. However, ILW needs no provision, or only limited provision, for heat dissipation during its storage and disposal. ILW may contain long lived radionuclides, in particular, alpha emitting radionuclides that will not decay to a level of activity concentration acceptable for near surface disposal during the time frame for which institutional controls can be relied upon. ILW requires disposal at greater depths, of the order of tens of meters to a few hundred meters. ILW may typically be storable waste.

HLW is defined as waste with levels of activity concentration high enough to generate significant quantities of heat by the radioactive decay process or waste with large amounts of long lived radionuclides that need to be considered in the design of a disposal facility for such waste. Disposal in deep, stable geological formations usually several hundred meters or more below the surface is the generally recognized option for disposal of HLW. HLW may typically be storable waste.

Prior to processing the radioactive waste according to the methods described herein, the radioactive waste may be analyzed and/or classified by conventional industry methods to determine the total concentration of the at least one radionuclide in the radioactive waste. This analysis may provide information helpful in determining the potential reduction in volume of the radioactive waste which will result from the methods described herein. The analysis process may include, but is not limited to, direct gamma spectroscopy measurement, liquid scintillation, elution of the resin with a strong acid or base and analysis of the eluent with gamma spectroscopy, and/or liquid scintillation counter for beta and alpha radiation. The resin may also be burned and an analysis of the ashes conducted using gamma spectroscopy and scintillation techniques.

Separating the ion exchange radioactive waste into cation resin waste and anion resin waste may be desirable prior to further processing of the wastes. Anion resin wastes may qualify as Class A or disposable wastes without further processing. Cation resin wastes, however, may not qualify as Class A or disposable wastes without further processing. Therefore, it may be desirable to process the cation resin waste (as well as the anion resin waste, if the anion resin waste qualifies as Class B or C waste (or storable waste) prior to processing) in order to reduce the volume of Class B and C wastes (or storable waste). In certain circumstances, care may need to be taken not to generate GTCC/storable wastes, because these wastes may be difficult and costly to handle and store. In other circumstances, however, it may be desirable to generate GTCC/storable wastes, at least for the purpose of storing the GTCC/storable wastes on-site at minimum volume. Many factors, including cost of storage and availability of disposal pathways, will affect whether or not it is desirable to generate GTCC/storable wastes.

Separation of the radioactive waste into cation resin waste and anion resin waste, if desired, may be accomplished by taking advantage of the different terminal settling velocities of the cation and anion resin wastes. In one embodiment, separation by backwash, the mixed ion exchange resin radioactive waste may be separated by placing the waste into a tall vessel and flowing water through the bottom of the vessel slowly. After a clear separation is observed, such as through a sight glass, the flow rate of the water is increased and the anion resin remaining in the vessel is transferred out from the top of the vessel.

In another embodiment, the cation resin and anion resin radioactive waste may be separated using a centrifuge or a gravity-dependent operation. For example, the CONESEP® system, available from Christ-Kennicott Water Technology Ltd (Wolverhampton, UK) relies on the difference in density between the cation and anion resins to effect separation. In the CONESEP® process, exhausted, mixed resin is transferred to a resin separation/anion regeneration vessel. A small amount of mixed resin isolated during a previous regeneration may be added from a resin isolation pot. The resins are backwashed and air scoured to remove particulates. The resin is backwashed again without air scour and the denser cation resin sinks to the bottom of the vessel. The interface is visible through a sight glass in the vessel. Carbon dioxide is carefully injected into the vessel and the resin transfer line is opened. The cation resin flows into a second vessel. The cone design of the vessel bottom gradually reduces the diameter of the resin interface and directs it into the outlet branch. As the resin interface moves into the transfer line, the difference in conductivity between the resins is detected. The transfer line is closed and the small amount of resin in the line is diverted to an interface isolation pot. A back-up optical cell detects the interface by color difference in the unlikely event of the conductivity cell failing.

While any separation technique may be used in the methods described herein, the above-described techniques may be undesirable for the following reasons. First, such techniques may be designed to separate only those resins which have a fixed ratio of cation resin and anion resin, such as a volumetric ratio of 40:60, respectively.

Second, in order to separate the radioactive ion exchange resin waste to maximize resulting Class A waste (or disposable waste) and minimize the volume of Class B, Class C or GTCC wastes (or storable wastes), it may be undesirable to separate the radioactive resin waste into strictly cation resin waste and anion resin waste. For example, this optimization may require that some of the cation resin be included with the primarily anion resin, but none of the anion resin be included with the cation resin (or vice versa).

Third, the radioactive ion exchange resin wastes which are processed by the methods disclosed herein may be in various ionic forms, such as but not limited to borate, lithium, hydrogen, or iron. Such fractions of the radioactive resins may have different densities, which may make separation by the above-described techniques difficult.

The moving freeboard separation technique described below overcomes these deficiencies by: (i) allowing for variable cation resin:anion resin ratios in the radioactive ion exchange resin waste; and (ii) utilizing the variable ionic forms which may be present in the radioactive ion exchange resin waste to provide separation of the resins beyond mere cation/anion separation.

Moving freeboard separation is accomplished utilizing an apparatus which comprises a vessel (such as a cylindrically-shaped vessel) and an inverted funnel. The radioactive waste to be separated is placed in the vessel, and a liquid, such as water, is pumped upwardly through the radioactive waste. This upwardly-flowing liquid is pumped at a velocity such that it separates the radioactive waste into layers based on density. While the velocity necessary to separate the radioactive waste into such layers will depend largely on the vessel size and geometry, in certain embodiments the liquid volumetric flow rate may be about 3 L/min to about 8 L/min for a 200 mm diameter vessel. The velocity for a specific vessel size and geometry may easily be determined by trial and error or by hydrodynamic modeling, which is a known technique. The inverted funnel is placed near the top of the vessel such that it provides a seal inside the vessel above the top of the highest layer of radioactive waste. The upwardly-flowing liquid flows through the inverted funnel after it passes through the radioactive waste.

Figure 4:
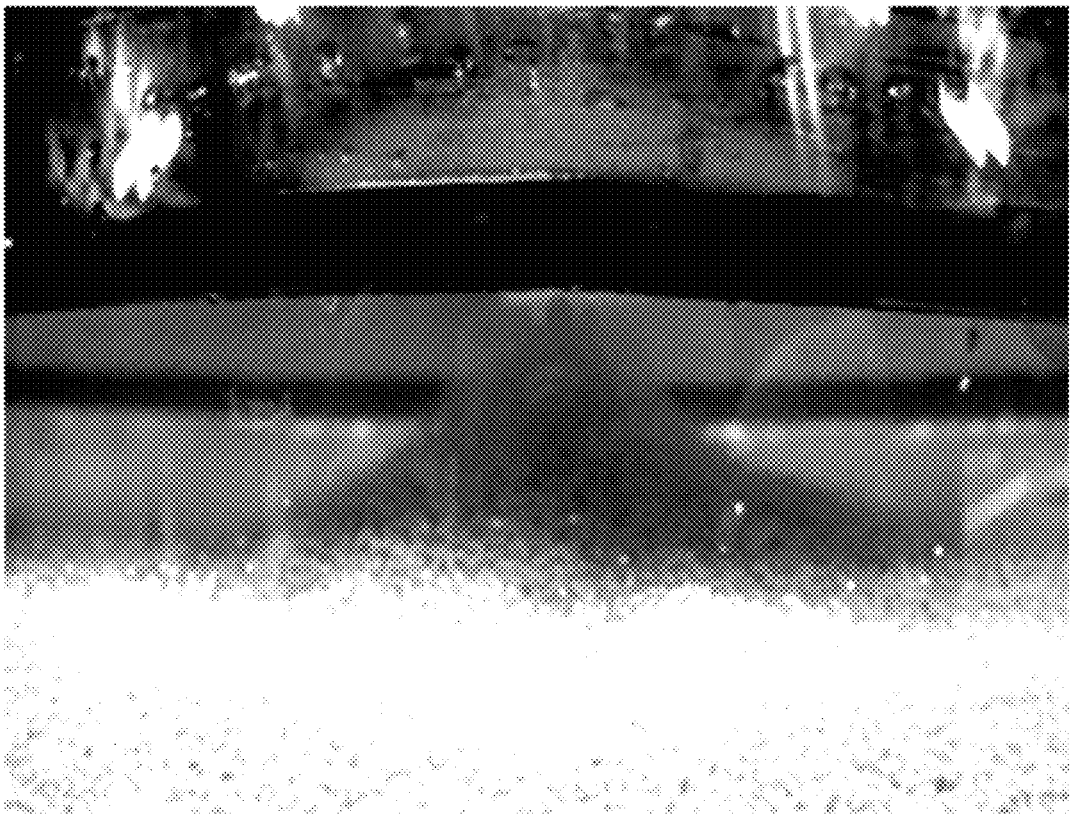
FIG. 4 is a photograph of an embodiment of a moving freeboard collector in operation.

In order to separate the radioactive waste, the inverted funnel is slowly descended through the dynamically-settled bed of radioactive waste. The shape of the inverted funnel is such that the inverted funnel creates an extraction vortex just above the top of the dynamically-settled radioactive waste bed, which allows for selective removal of the distinct layers of radioactive waste from the vessel. An example of one embodiment of the moving freeboard which creates such an extraction vortex is shown in FIG. 4. As the inverted funnel is descended through the vessel, the inverted funnel extracts the various layers of radioactive waste created by the upwardly-flowing liquid. A valve or manifold may be provided downstream of the inverted funnel such that the various layers of radioactive waste may be directed to individual separation vessels.

The inverted funnel may be of any geometry, such as v-shaped funnels with high or low aspect ratios, or funnels which have curved walls. It has been found that bell-shaped funnels work well with cylindrically-shaped vessels. The shape of the inverted funnel, may be designed to have an aspect ratio sufficiently low to allow the resin to be removed efficiently in the extraction vortex, and sufficiently high to avoid disturbance of the top of the dynamically-settled radioactive waste bed.

The dynamically-settled bed of radioactive waste may typically comprise lower-level radioactive waste towards the top of the dynamically-settled bed, with higher-level radioactive waste towards the bottom. In certain embodiments, there may be as many as four or five (or more) distinct layers of radioactive waste in the dynamically-settled bed of radioactive waste, depending on the composition of the radioactive waste. The moving freeboard therefore allows for individual extraction of each distinct layer. Prior to separation, the dynamically-settled bed may be analyzed in order to determine the most efficient separation.

The desired amount of resin to be removed may be determined by prior analysis of the radioactive ion exchange resin waste, such as by a "sight glass" approach or by collimated gamma radiation dose measurements at different heights of the vessel. Due to high radiation levels, a sight glass cannot be observed directly, but the required information may be obtained by a televisual link, or by providing mirrors and a mirror path which provides direct sight, but does not allow "radiation shine".

In certain embodiments, the resin separation system may not be needed, depending on the substance used to displace ions in the cation and anion radioactive resin wastes. For example, an elution method utilizing a high concentration of calcium hydroxide, calcium chloride or similarly strong divalent base or salt to the resin mix will displace all of the other ions because of the high concentration and divalent form of the calcium ion. The strong attraction of the calcium ion will have sharp chromatographic fronts, therefore it is possible to minimize the amount of liquid waste that needs to be processed. Further, if resin separation is desired, the calcium hydroxide may aid in resin separation by increasing the density of the cation exchange resin. Calcium ions are also used as ingredients in cementitious mixtures, so the presence of calcium ions may increase the effectiveness of encapsulating the resin wastes in cementitious compositions for stable storage, if desired. Without limitation, other suitable divalent cations which may be used similarly to calcium are magnesium, strontium, barium, iron, or other transition metal salts.

After separation (when conducted), the regenerated radioactive wastes may be sampled and analyzed by conventional industry methods (such as elution followed by gamma spectroscopy and scintillation techniques) in order to determine whether they meet Class A waste limits.

In certain embodiments, the methods described above may further comprise removing at least a portion of the at least one radionuclide present in the regenerant waste, to produce a reduced-volume radionuclide waste. In a further embodiment, the reduced-volume radionuclide waste may be capable of being classified as Class B waste or Class C waste (or storable waste). In still a further embodiment, the regenerant waste may be neutralized prior to removing at least a portion of the at least one radionuclide. For example, caustic (NaOH) may be added to a waste solution comprising a mineral acid such as sulfuric acid.

In certain embodiments, the methods described above may further comprise exposing the regenerant waste to an acidic aqueous solution, and, after said exposing, passing the acidic aqueous solution containing at least a portion of the regenerant concentration of the at least one radionuclide through an electrochemical ion exchange cell such that at least a portion of the regenerant concentration of the at least one radionuclide is removed by attracting the at least one radionuclide to a cathode surface of the electrochemical ion exchange cell.

The cathode may thereafter be rinsed with an aqueous wash solution to remove the at least one radionuclide from the cathode surface. The aqueous wash solution containing the at least one radionuclide removed from the cathode surface may be purified to remove at least a portion of the at least one radionuclide present in the aqueous wash solution such that the aqueous wash solution may be reused and/or recycled.

The separation methods may vary based on the target nuclide in some embodiments. For example; nickel-63 (Ni-63) is a transition metal and is moderately soluble in acids, while it precipitates in highly alkaline environments. It may be desirable to regenerate the resin using an acid or acidic salt after resin separation in this embodiment. In certain embodiments, cesium (Cs) will be soluble in acid or alkaline environments, and a calcium hydroxide solution can remove it from the cation resin without further separation techniques.

If all three radionuclides are present (Ni-63, strontium-90 (Sr-90) and Cs-137), various chemical methods (acid or base) may be used to elute the radionuclides and process them as described herein below. In some embodiments, the wash solution may be run through an existing Class C resin, through a small sample of Class A resin, it may be precipitated chemically or electrochemically, or it may be processed by solidification, such as by mixing it with a small volume of concrete.

In certain embodiments, the at least one radionuclide may be at least one of nickel-63, strontium-90 or cesium-137. Without limitation, these radionuclides are commonly found in radioactive wastes, such as ion exchange resins, which have been used for rehabilitating the primary side of the cooling system of a nuclear power plant. Therefore, the concentrations of these radionuclides in these radioactive wastes may be determinative of the classification, as Class A, Class B or Class C, of these radioactive wastes. However, other radionuclides may be found in these radioactive wastes, and may also be determinative of the classification of such wastes.

In certain embodiments, the cation resin waste obtained by any of the methods described above may comprise a cation resin, and the method(s) may further comprise regenerating the cation resin with sulfuric acid, iron formate, magnesium hydroxide, magnesium chloride, calcium hydroxide, calcium chloride, strontium hydroxide, or barium hydroxide, and capturing the eluent acids, bases, or salts in the regenerant waste.

In certain embodiments, the methods described above may further comprise measuring the regenerant concentration of the at least one radioactive nuclide remaining in the regenerant waste. The regenerant waste may be classified as Class A waste, Class B waste, or Class C waste based on the regenerant concentration. In certain embodiments, the regenerant waste may be classified as disposable waste or storable waste.

For purposes of illustration but not limitation, anion, cation and mixed ion exchange resins suitable for use in nuclear power applications, available from The DOW Chemical Company (USA), include those in the following table.

| Product | Description | Type | Matrix | Total Exchange Capacity eq/l (kgr/ft$^3$) | Available Forms |
|---|---|---|---|---|---|
| AMBERLITE ™ IRN77 | Uniform particle size cation exchange resin for nuclear power applications. | Strong Acid Cation | Styrene divinylbenzene copolymer | ≥1.90 | $H^+$ |
| AMBERLITE IRN78 | Uniform particle size anion exchange resin for nuclear power applications. | Strong Base Anion | Styrene divinylbenzene copolymer | ≥1.20 | $OH^-$ |
| AMBERLITE IRN97 H | Uniform particle size cation exchange resin for nuclear power applications. | Strong Acid Cation | Polystyrene divinylbenzene copolymer | ≥2.15 | $H^+$ |
| AMBERLITE IRN99 | Uniform particle size cation exchange resin for nuclear power applications. | Strong Acid Cation | Polystyrene divinylbenzene copolymer | ≥2.40 | $H^+$ |
| AMBERLITE IRN150 | Uniform particle size mixed ion exchange resin for nuclear power applications. | Mixed | Styrene divinylbenzene copolymer | ≥1.90<br>≥1.20 | $H^+$<br>$OH^-$ |
| AMBERLITE IRN160 | Uniform particle size mixed ion exchange resin for radwaste and nuclear power applications. | Mixed | Styrene divinylbenzene copolymer | ≥2.15<br>≥1.20 | $H^+$<br>$OH^-$ |
| AMBERLITE IRN170 | Uniform particle size mixed ion exchange resin for non-regenerable nuclear power applications. | 1:1 by equivalent cation:anion | Styrene divinylbenzene copolymer | ≥2.40<br>≥1.20 | $H^+$<br>$OH^-$ |
| AMBERLITE IRN217 | Uniform particle size mixed ion exchange resin for nuclear power applications. | Mixed | Styrene divinylbenzene copolymer | ≥1.75<br>≥1.20 | $Li^{7+}$<br>$OH^-$ |
| AMBERLITE IRN317 | Mixed ion exchange resin for Chemical and Volume Control System (CVCS) of Pressurized Water Reactors (PWR). | 1:1 by equivalent cation:anion | Polystyrene divinylbenzene copolymer | ≥2.40<br>≥1.20 | $Li^{7+}$<br>$OH^-$ |

An embodiment of a system 10 which may be used to carry out the present methods is shown in FIG. 1. Radioactive wastes produced as described above are deposited into a resin storage tank 12. The radioactive wastes are sent via a waste conduit 14 (via eduction or sluicing) to a resin separation vessel 16, where the radioactive waste may or may not be separated into cation resin waste and anion resin waste. If the separation is needed, the cation resin waste proceeds via a cation conduit 18 to a cation resin vessel 26. In certain embodiments, the resin separation vessel may also comprise the cation resin vessel. A regenerant acid/base/salt vessel 22 provides acid/base/salt via an acid/base/salt conduit 24 to the cation resin vessel 26. The cation resin is processed in the cation resin vessel 26 such that a regenerant waste may be sent via a regenerant conduit 30 to a regenerant waste tank 38, and the regenerated cation resin may be sent via a regenerated cation conduit 28 to a discard resin tank 36. Resin transferred to the discard resin tank 36 is typically at Class A limits or less.

The anion resin flowing from the resin separation vessel 16 is sent via an anion resin conduit 20 using eduction or resin sluicing to an anion resin vessel 32. The anion resin may be regenerated in the anion resin vessel 32, if required, such that regenerated anion resin may be sent via a regenerated anion resin conduit 34 to the discard resin tank 36. Optionally, the regenerant waste from the anion resin vessel 32 may also be sent via a conduit (not shown) to the regenerant waste tank 38. The regenerant waste in regenerant waste tank 38 is sent via a conduit 40 to a regenerant process 42, where the radionuclides present in the regenerant waste may be further volume-reduced using one of several methods such as Electric Power Research Institute (EPRI) DFDX, electrodeionization, ion exchange media (organic or inorganic), precipitation, or solidification. In certain embodiments, the vessels, conduits and process described with regard to FIG. 1 may comprise carbon steel, stainless steel alloys, or a plastic material, and the vessel may be lined with a material which is resistant to certain resin or waste chemistry, if necessary.

Figure 2:
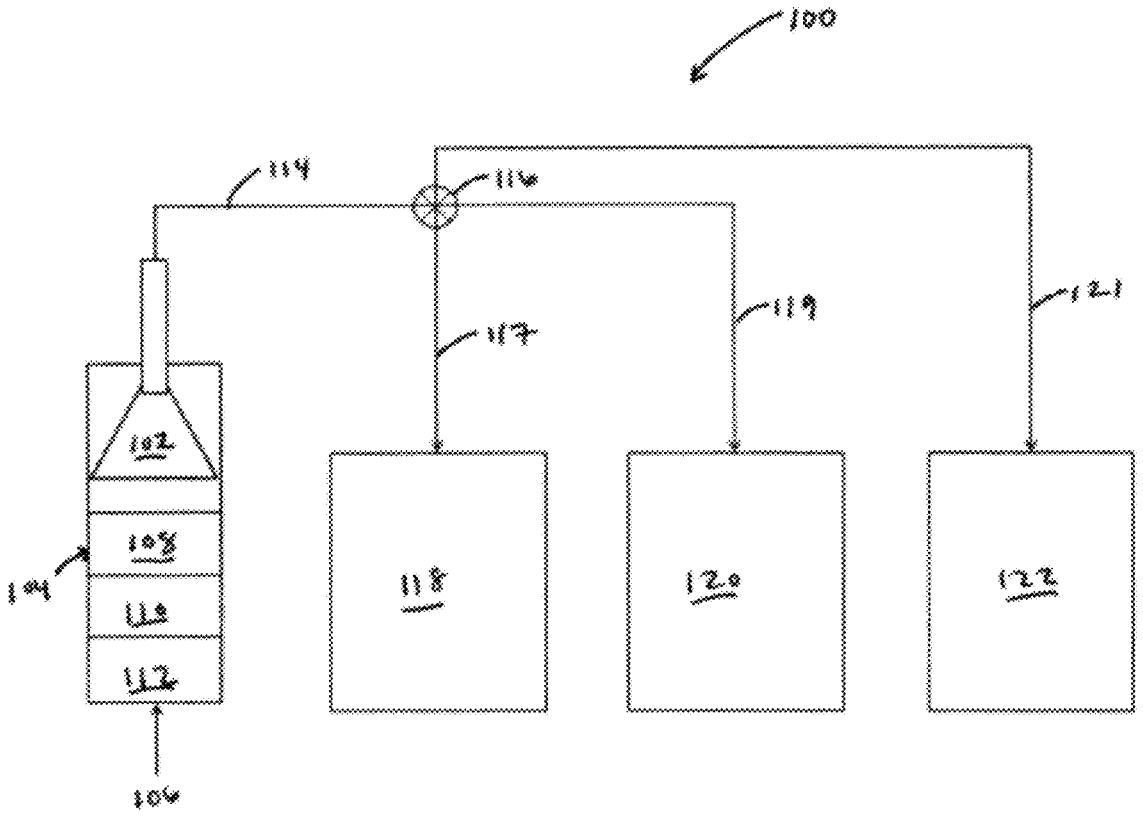
FIG. 2 is a schematic diagram of one embodiment of the present method(s).
Figure 3:
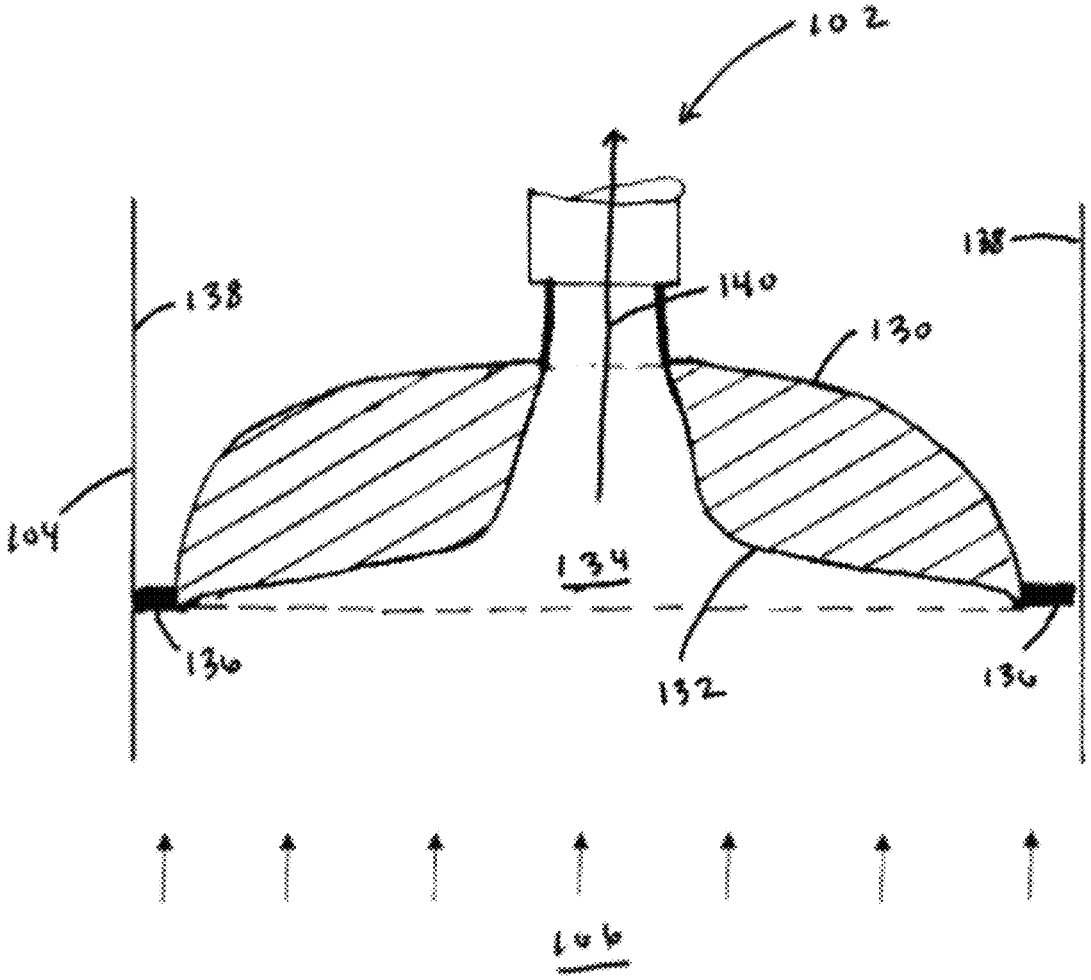
FIG. 3 is a cross-section of an embodiment of a collector for use in the embodiment of FIG. 2.

An embodiment of the present moving freeboard system 100 which may be utilized to carry out the methods disclosed herein is shown in FIGS. 2 and 3. The moving freeboard system 100 comprises a collector 102, a separation vessel 104, conduits 114, 117, 119, 121, collection vessels 118, 120, 122, and a valve or manifold 116. Radioactive waste placed in the separation vessel 104 separates into fractions as upwardly-flowing liquid 106 is pumped through the radioactive waste. The upwardly-flowing liquid 106 separates the radioactive waste into a first layer 108, a second layer 110 and a third layer 112 based on (increasing) density. The collector 102 is descended through the separation vessel 104 in order to sequentially separate the first layer 108, the second layer 110 and the third layer 112. The radioactive waste leaving the separation vessel 104 proceeds through conduit 114 to valve or manifold 116. As the first layer 108 is separated by collector 102, the valve or manifold 116 is positioned such that the first layer 108 flows through conduit 117 into collection vessel 118. After the first layer 108 is removed from the vessel 104 by the descending collector 102, the second layer 110 is separated by collector 102 and the valve or manifold is positions such that the second layer 110 flows through conduit 119 into collection vessel 120. After the second layer 110 is removed from the vessel 104, the third layer 112 is separated by collector 102 and the valve or manifold 116 is positioned such that the third layer 112 flows through conduit 121 into collection vessel 122.

The collector 102 is shown in more detail in FIG. 3. The collector 102 comprises an inverted funnel 130 placed in a vessel 104 having internal vessel walls 138. The inverted funnel 130 creates an extraction vortex 134 as the upwardly-flowing liquid 106 enters the inverted funnel 130. The extraction vortex 134 has a vortex profile 132 which allows the radioactive waste (not shown) to be selectively extracted by the inverted funnel 130 and the upwardly-flowing liquid 106. The extracted radioactive waste 140 proceeds through the top of the inverted funnel 130. A circumferential seal 136 provides a seal between the inverted funnel 130 and the interior vessel walls 138, so that no radioactive waste can bypass the inverted funnel 130. FIG. 4 shows an embodiment of the collector 102 in operation, illustrating the effect of the extraction vortex 134 on the radioactive waste.

The following example illustrates one embodiment of the present disclosure. A nuclear power plant generates 1 $m^3$ of radioactive waste comprising ion exchange resin with 40% by volume of the resin comprising a cation resin and 60% comprising an anion resin. The resin is sampled and analyzed and found to contain 100 curies of cesium-137. Therefore, the resin is classifiable as Class C waste according to Table 2, as described above. The remaining radionuclides are well under Class A limits, and therefore are not considered.

The resin is transferred into a resin storage vessel and backwashed in order to remove the anion resin, which is sent to an anion resin vessel. Because cesium-137 is a cation, little to no cesium-137 is found in the anion resin, and the anion resin may be classified as Class A waste. The cation resin may remain in the resin storage vessel, or may be sent to a cation resin vessel.

The remaining cation resin, which is a 0.4 $m^3$ volume, contains 100 curies of cesium-137. The cation resin is regenerated in the resin storage vessel or the cation resin vessel with a solution, which may comprise at least one of sulfuric acid, calcium hydroxide, sodium hydroxide, calcium chloride, or other salts that are useful for electrochemistry practices, such as iron formate. The regenerated cation resin is sent to a discard resin tank, from which the cation resin may be disposed as Class A waste, and optionally a small portion of the resin may be used for regenerant processing. The solution, such as sulfuric acid, calcium hydroxide, calcium chloride, and/or iron formate solution, is sent to a regenerant waste tank, where it is sampled and analyzed in order to determine its concentration of cesium-137. The solution may then be processed in order to reduce the volume of the cesium-137 for easier handling, disposal and/or storage.

Such processing may be conducted by the EPRI DFDX™ process, which can reduce the volume of certain types of radioactive materials by converting them to metallic particulate form, and/or selective ion exchange, in this example cesium specific media, which can be used to reduce the volume of the radioactive materials to the extent desired. Neutralization of the sulfuric acid/calcium hydroxide solution with caustic (NaOH)/sulfuric acid may be conducted to adjust to the operable pH range of the nuclide specific media.

Other processes may be conducted in order to reduce the volume of radioactive materials, such as evaporation using drum dryers, solidification in a hydraulic binder such as concrete, processing with a smaller ion exchange media volume or electrodeionization. Resins processed according to the present methods may also be recycled and used for regenerant waste purification processes. It is noted that nuclides such as cesium and strontium have higher selectivities than sodium. Cesium selective media include, but are not limited to, CS TREAT (trade name) ion exchanger comprising potassium-cobalt hexacyanoferrate(II) produced by Selion Oy (Finland), IONSIV™ IE 910 silicotitanate produced by UOP LLC (USA), and SIR-600™ and SIR-635™ cesium specific zeolite produced by ResinTech (USA).

In certain embodiments, the EPRI DFDX process for removing radioactive cations from a mineral or organic acid decontamination solution comprises exposing contaminated materials to the decontamination solution; passing the decontamination solution containing radioactive cations through a central compartment of an electrochemical ion exchange cell which is separated from an anode compartment having an anode by a first ion exchange membrane; recycling the decontamination solution for reuse in the exposing step; applying a voltage across the cathode and anode; attracting the radioactive cations to the cathode; depositing the radioactive cation on the cathode as radioactive metal particles; and flowing a cathode solution over the cathode to detach the radioactive metal particles. The radioactive metal particles may be separated from the cathode solution in a settling tank, and the cathode solution may be recirculated to the cathode compartment. This process is described in U.S. Pat. No. 6,682,646, incorporated herein by reference.

In the EPRI DFDX process, suitable decontamination solutions may include any mineral or organic acid. Examples of mineral acids are: nitric acid, fluoroboric acid, sulfuric acid and hydrochloric acid. The choice of acid may depend on a number of factors, such as effectiveness in dissolving the contamination, solubility of the contaminants in the relevant acid, material compatibility, and downstream processing compatibility. In applications where the component materials are particularly sensitive to corrosion, an organic acid may be used. Examples of organic acids are: formic acid, citric acid, oxalic acid and ethylene diamine tetraacetic acid. The acid concentration of the decontamination solution is not exclusively bound to be within any specific limits. However, in certain embodiments, the range of acid concentration in the decontamination solution may be in the range between $10^{-3}$ and $10^{-2}$ M.

Suitable cathode solutions for the EPRI DFDX process may include solutions containing electrolytes. In certain embodiments, the electrolyte comprises formic acid, sodium formate, or mixtures thereof. In other embodiments, the cathode solution may comprise a $10^{-3}$ M fluoroboric acid solution adjusted to a pH of 3 with sodium hydroxide.

It will be understood that the embodiments described herein are merely exemplary, and that one skilled in the art may make variations and modifications without departing from the spirit and scope of the invention. All such variations and modifications are intended to be included within the scope of the invention as described hereinabove. Further, all embodiments disclosed are not necessarily in the alternative, as various embodiments of the invention may be combined to provide the desired result.

We claim:

1. A method of processing ion exchange resin radioactive waste, wherein the radioactive waste contains three or more fractions of radioactive waste based on density, wherein the radioactive waste includes at least one of cation resin waste and anion resin waste, wherein at least one of the three or more fractions comprises a total concentration of at least one radionuclide, comprising performing the following operation (i) and optionally at least one of the following operations (ii) or (iii):

(i) separating the three or more fractions from the radioactive waste utilizing a moving freeboard;

(ii) separating the radioactive waste into at least one of cation resin waste and anion resin waste; or (iii) removing at least a portion of the total concentration of the at least one radionuclide from: (a) the radioactive waste; (b) the at least one of the three or more fractions separated by the moving freeboard; or (c) at least one of the cation resin waste or the anion resin waste;

wherein after performing operation (i) and optionally at least one of operations (ii) and (iii), at least one of: (a) the radioactive waste resulting from at least one of operations (i)-(iii); (b) the at least one of the three or more fractions; or (c) at least one of the cation resin waste or the anion resin waste; has a residual concentration of the at least one radionuclide, and is classifiable as disposable waste based on said residual concentration; and wherein a regenerant waste, which comprises: (1) the radioactive waste remaining after separating the at least one of the three or more fractions in operation (i); and/or (2) the at least a portion of the total concentration of the at least one radionuclide which has been removed via operation (iii); has a regenerant concentration of the at least one radionuclide, and is classifiable as disposable waste or storable waste based on the regenerant concentration.

2. The method of claim 1, wherein the at least one radionuclide is at least one of nickel-63, strontium-90 or cesium-137.

3. The method of claim 1, further comprising removing at least a portion of the at least one radionuclide present in the regenerant waste, to produce a reduced-volume radionuclide waste.

4. The method of claim 3, wherein the reduced-volume radionuclide waste is classifiable as storable waste.

5. The method of claim 3, further comprising neutralizing the regenerant waste prior to removing at least a portion of the at least one radionuclide.

6. The method of claim 3, wherein said removing at least a portion of the at least one radionuclide present in the regenerant waste comprises exposing the regenerant waste to an acidic or basic aqueous solution, and after said exposing, subjecting the acidic or basic aqueous solution containing at least a portion of the regenerant concentration of the at least one radionuclide to at least one of electrochemical ion exchange, chemical precipitation, electrochemical precipitation, or solidification.

7. The method of claim 6, wherein the acidic or basic aqueous solution containing at least a portion of the regenerant concentration of the at least one radionuclide is subjected to electrochemical ion exchange, and wherein said electrochemical ion exchange comprises passing the acidic or basic aqueous solution containing at least a portion of the regenerant concentration of the at least one radionuclide through an electrochemical ion exchange cell such that at least a portion of the regenerant concentration of the at least one radionuclide is removed by attracting the at least one radionuclide to a cathode surface of the electrochemical ion exchange cell.

8. The method of claim 7, further comprising rinsing the cathode surface with an aqueous wash solution to remove the at least one radionuclide from the cathode surface.

9. The method of claim 8, further comprising purifying the aqueous wash solution containing the at least one radionuclide removed from the cathode surface to remove at least a portion of the at least one radionuclide present in the aqueous wash solution such that the aqueous wash solution may be reused and/or recycled.

10. The method of claim 6, wherein the acidic or basic aqueous solution containing at least a portion of the regenerant concentration of the at least one radionuclide is subjected to solidification, and wherein said solidification comprises mixing the aqueous solution with a cementitious composition.

11. The method of claim 1, wherein the radioactive waste is separated into cation resin waste, and further comprising regenerating the cation resin waste with an acid and/or a salt, and capturing removed radioactive acid and/or salt in the regenerant waste.

12. The method of claim 11, wherein the acid and/or salt is at least one of sulfuric acid, hydrochloric acid, calcium hydroxide, sodium hydroxide, calcium chloride, or iron formate.

13. The method of claim 1, wherein the radioactive waste is separated into at least one of cation resin waste and anion resin waste, and further comprising regenerating at least one of the cation resin waste and/or the anion resin waste.

14. The method of claim 13, wherein the regenerated at least one of the cation resin waste and/or the anion resin waste is reused and/or recycled.

15. The method of claim 1, wherein the moving freeboard comprises a vessel and an inverted funnel inside the vessel, the operation (i) comprising:

disposing the radioactive waste in the vessel below the inverted funnel;

flowing a liquid upwardly through the radioactive waste, such that the upwardly-flowing liquid causes the radioactive waste to become dynamically settled into the three or more fractions, wherein the upwardly-flowing liquid flows through the inverted funnel, creating an extraction vortex within the inverted funnel; and descending the inverted funnel through the vessel;

wherein each of the three or more fractions of radioactive waste are sequentially separated and removed from the vessel by the descending inverted funnel.

* * * * *